US008381710B2

(12) United States Patent
Nguyen

(10) Patent No.: US 8,381,710 B2
(45) Date of Patent: Feb. 26, 2013

(54) PAINTBALL EJECTING APPARATUSES AND METHODS THEREFOR

(76) Inventor: Dong Thanh Nguyen, Rowlett, TX (US)

( * ) Notice: Subject to any disclaimer, the term of this patent is extended or adjusted under 35 U.S.C. 154(b) by 0 days.

(21) Appl. No.: 12/962,400

(22) Filed: Dec. 7, 2010

(65) Prior Publication Data

US 2012/0138036 A1 Jun. 7, 2012

(51) Int. Cl.
*F41B 11/02* (2006.01)

(52) U.S. Cl. ..... 124/51.1

(58) Field of Classification Search ..... 124/48, 124/49, 51.1, 73, 74

See application file for complete search history.

(56) References Cited

U.S. PATENT DOCUMENTS

| | | | | |
|---|---|---|---|---|
| 6,415,781 | B1 * | 7/2002 | Perrone | 124/51.1 |
| 6,418,919 | B1 * | 7/2002 | Perrone | 124/49 |
| 6,467,473 | B1 * | 10/2002 | Kostiopoulos | 124/51.1 |
| 6,488,019 | B2 * | 12/2002 | Kotsiopoulos | 124/51.1 |
| 6,609,511 | B2 * | 8/2003 | Kotsiopoulos et al. | 124/51.1 |
| 7,441,556 | B2 * | 10/2008 | Friesen et al. | 124/51.1 |
| 7,966,999 | B2 * | 6/2011 | Bosch et al. | 124/51.1 |
| 2003/0005917 | A1 * | 1/2003 | Kim | 124/59 |
| 2005/0274371 | A1 * | 12/2005 | Lubben | 124/51.1 |
| 2006/0157041 | A1 * | 7/2006 | Friesen | 124/51.1 |
| 2007/0012304 | A1 * | 1/2007 | van Dorsser et al. | 124/51.1 |
| 2007/0256676 | A1 * | 11/2007 | Orvis et al. | 124/31 |
| 2008/0236558 | A1 * | 10/2008 | Bosch et al. | 124/48 |
| 2011/0220086 | A1 * | 9/2011 | Bosch et al. | 124/51.1 |

* cited by examiner

*Primary Examiner* — Bret Hayes

(74) *Attorney, Agent, or Firm* — IPSG, P.C. Intellectual Property Law

(57) ABSTRACT

Paintball ejecting apparatus having a body, a breech, and a barrel for ejecting paintballs through and out of the barrel is disclosed. There are included a paintball reservoir disposed in an other-than-top-of-body position and a paintball conduit coupling the paintball reservoir to the breech for facilitating transport of paintballs from the paintball reservoir to the breech. There is also included a paintball transport arrangement having an actuator to move paintballs toward the breech, the paintball transport arrangement automatically moves at least a first paintball from the paintball conduit into the breech if the breech is empty and open for receiving the at least first paintball, the paintball transport arrangement automatically ceasing moving another paintball into the breech after the at least first paintball is disposed in the breech.

24 Claims, 6 Drawing Sheets

PAINTBALL EJECTING APPARATUSES AND METHODS THEREFOR

BACKGROUND OF THE INVENTION

Paintball is a hobby and a sport that has been popular for a number of years. A paintball game may involve multiple users, each of whom is equipped with a paintball gun. The paintball gun is generally designed to eject or shoot paintballs onto a target when the operator aims the paintball gun at the target and squeezes the trigger. Scores are then kept for the number of hits, the location of hits, the number of times a player is shot at, etc. In addition to its recreational role, paintball guns may also be used to mark trees, cattle, and the like.

FIG. 1 shows a simplified schematic of a prior art paintball gun 102, including a barrel 104 and a body 106. A hopper 108 is disposed atop of body 106 and is designed to hold a number of paintballs. The operator typically pre-loads a hopper 108 through a lid 110. Gravity-fed or force-fed paintballs then enter the breech. When the operator pulls trigger 112, a predetermined volume of compressed gas from a compressed gas bottle 114 pushes the paintball out of the breech and along barrel 104 on its way to the target.

While the prior art paintball gun of FIG. 1 serves its purpose, there are disadvantages. For example, the presence of a large hopper of paintballs atop gun body 106 presents a larger target area for other players to shoot at. Under certain competition rules, a paintball striking any part of an opponent's paintball gun, including hopper 108, represents a hit. Accordingly, a player may suffer a larger number of "hits" if his paintball gun presents a larger target area. Further, the position of hopper 108 relative to gun body 106 introduces center of gravity concerns. This is particularly true when hopper 108 is filled with paintballs. Since hopper 108 is disposed on top of body 106, the high center of gravity makes the paintball gun less stable, leading to fatigue and inaccurate shooting. As another example, the forward position of hopper 108 relative to the gun handle means that the paintball gun of FIG. 1 tends to be nose-heavy, requiring the operator to compensate using his wrist. Over time, this forward position too leads to earlier fatigue and/or inaccurate shooting.

In view of the foregoing, there are desired improved apparatuses and methods for shooting paintballs.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
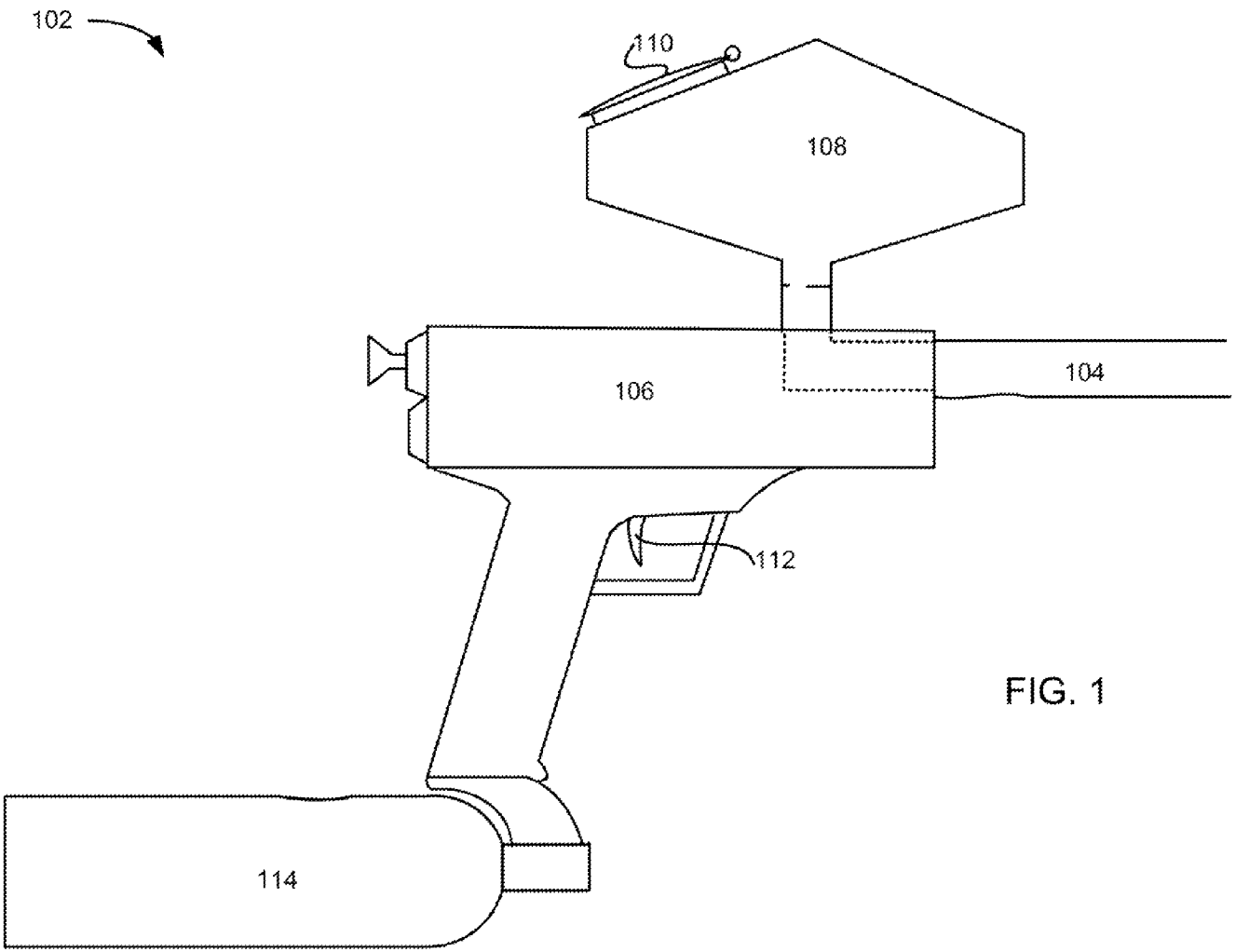
FIG. 1 shows a simplified schematic of a prior art paintball gun.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Embodiments of the invention relate to a paintball ejecting apparatus, such as a paintball gun, for ejecting paintballs from a breech through and out of a barrel. In one or more embodiments, a paintball reservoir is mounted away from the top of the gun's body. In this position, referred to herein as "other-than-top-of-body position", the center of gravity is lowered and brought closer to the operator's body, thereby improving stability and reducing hand or wrist fatigue during extended use.

The paintball reservoir is connected to the breech via a paintball conduit, which functions as a transport pathway and queue for paintballs between the paintball reservoir and the breech. Paintballs are queued in the paintball conduit in preparation for transport into the breech. Paintballs deposited into the breech are ejected or fired out of the barrel (using for example compressed air or $CO_2$) when the operator activates a trigger or switch.

In accordance with one or more embodiments of the invention, a paintball transport arrangement is provided. The paintball transport arrangement automatically moves paintballs from the paintball conduit into the breech when the breech is empty and open for receiving paintballs. The moving of one or more paintballs into the breech makes room for additional paintballs to be moved into the paintball conduit from the paintball reservoir. After a paintball is deposited into the breech and ready for firing and the paintballs are jammed against one another in the paintball conduit, the paintball transport arrangement automatically ceases moving paintballs into the breech and/or the paintball conduit and waits until the next time the breech is open to receive a paintball.

In accordance with one or more embodiments of the invention, the paintball moving force (i.e., the force employed to move the paintball from the paintball reservoir to the breech via the paintball conduit) is provided by an actuator working in cooperation with a transport mechanism. The actuator may be an electrical motor, a pneumatic actuator, springs, and/or levers, etc. The transport mechanism represents in one or more embodiments a helical auger, a screw auger, a wheel, or a conveyor belt assembly, for example. The actuator is configured to provide paintball moving force to the transport mechanism whenever a paintball needs to be moved from the paintball conduit to the breech and/or from the paintball reservoir into the paintball conduit.

Figure 2:
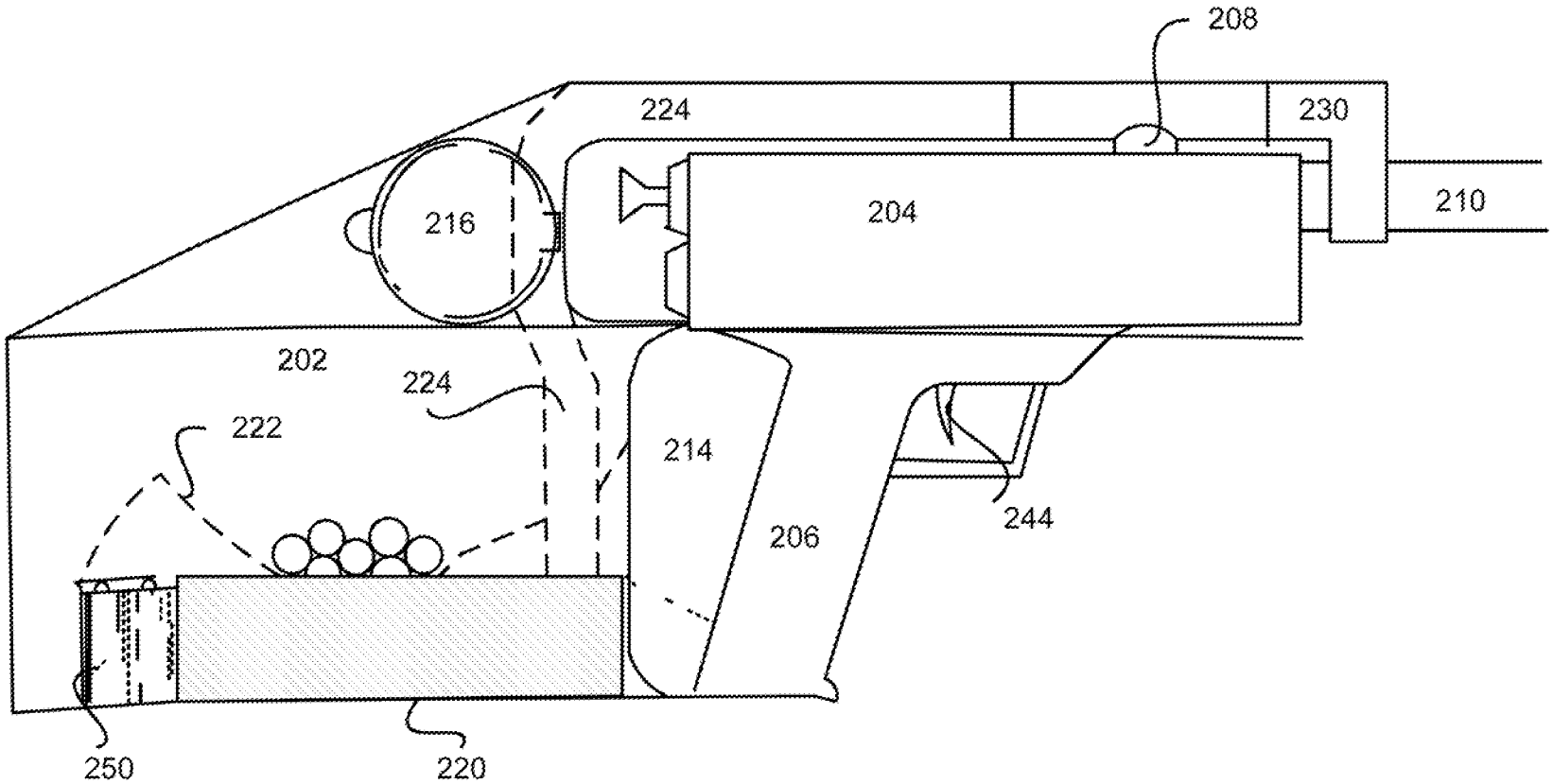
FIG. 2 shows, in accordance with an embodiment of the invention, an improved paintball gun.

The features and advantages of the present invention may be better understood with reference to the figures and discussions that follow. FIG. 2 shows, in accordance with an embodiment of the invention, a paintball gun 200, including a paintball reservoir 202, a body 204, a handle 206, a breech 208, and a barrel 210. Instead of being mounted on top of body 204, paintball reservoir 202 has been moved to a more proximal position relative to the operator's body as well as a lower center-of-gravity position. The repositioning of paintball reservoir 202 both reduces the target profile of the paintball gun as well as lowers its center of gravity and moves the center of gravity back to balance out the paintball gun when the operator grips handle 206. In the example of FIG. 2, paintball reservoir 202 is disposed proximal of (e.g., behind) handle 206 and closer to the operator body such that handle 206 is disposed between paintball reservoir 202 and trigger 244. However, paintball reservoir 202 or portion thereof may be disposed at any suitable location, including beside the gun body or under the handle, for example.

In the embodiment of FIG. 2, a thumb hole 214 is provided but this may be optional in some other embodiments. A refill cap 216 is shown. Refill cap 216 may be positioned on any suitable surface of paintball reservoir 202. The operator may utilize refill cap 216 to replenish paintball reservoir 202 with paintballs.

Paintball transport arrangement 220 is disposed under a chute or funnel 222, which serves to direct paintballs to fall into an opening of a paintball conduit, part of which is disposed within paintball transport arrangement 220. The construction and operation of paintball transport arrangement 220 will be discussed in details in FIG. 3 hereinbelow.

Paintballs are moved through paintball transport arrangement 220 and fed to breech 208 via a paintball conduit 224 that spans from chute 222 to breech 208. Within the paintball conduit 224, paintballs are queued and automatically fed into breech 208 when breech 208 is empty and open for receiving paintballs. Once at least one paint ball is fed into breech 208 and the paintballs are jammed against one another in the paintball conduit, paintball transport arrangement 220 automatically ceases feeding paintballs along paintball conduit 224 to breech 208. An optional conduit brace 230 is also shown to help mechanically stabilize paintball conduit 224 by bracing paintball conduit 224 against barrel 210. When the operator pulls a trigger 244, the paintball in breech 208 is ejected or fired through and out of barrel 210. Thereafter, the breech 208 may open, ready to receive another paintball.

Figure 3:
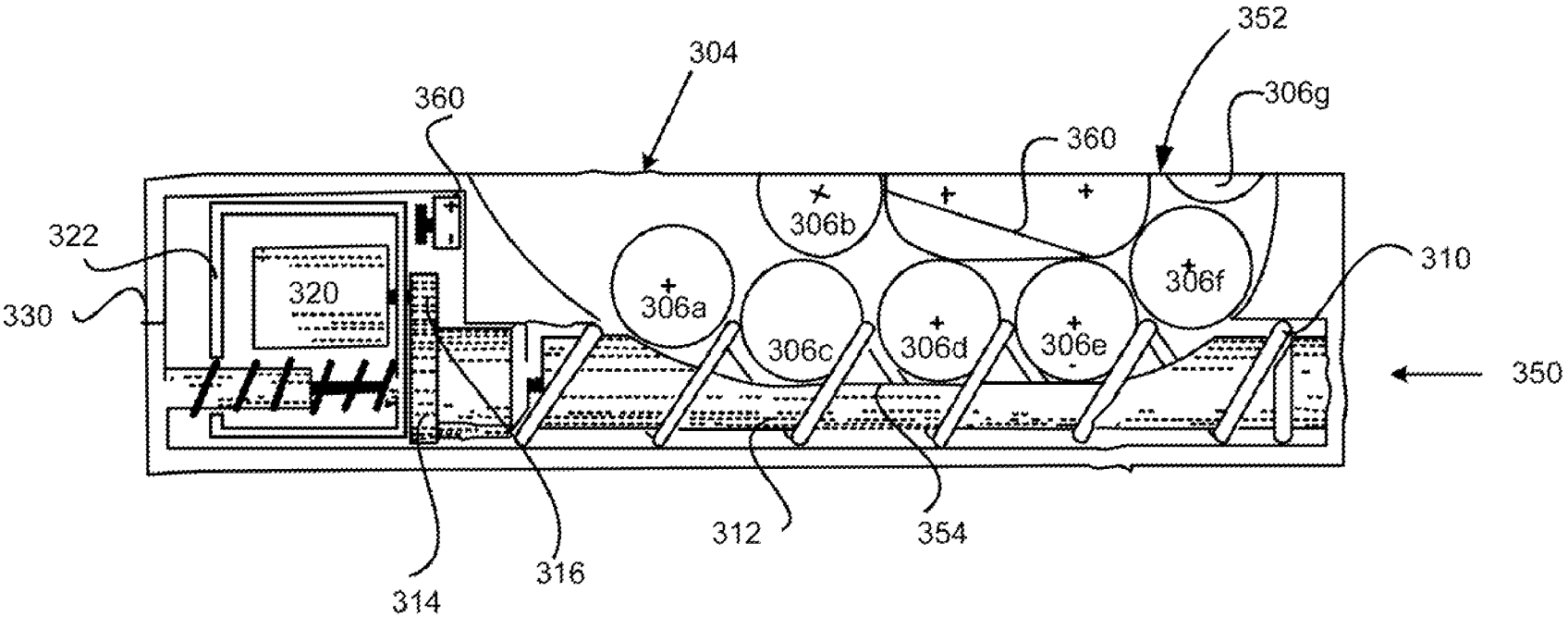
FIG. 3 shows, in accordance with an embodiment of the invention, an implementation of a paintball transport arrangement.

FIG. 3 shows, in accordance with an embodiment of the invention, an implementation of paintball transport arrangement 220 in greater detail. With reference to FIG. 3, conduit portion 352 represents a portion of the paintball conduit that spans from opening 304 to breech 208. A plurality of paintballs are shown queued up in conduit portion 352, of which paintballs 306*a*, 306*b*, 306*c*, 306*d*, 306*e*, 306*f*, and 306*g* are shown. A helical auger 310, which may be formed of plastic or metal, rotates around a core 312. Helical auger 310 is coupled to a gear 314, which in turn engages with a gear 316. Gear 316 is coupled to an electrical motor 320, which receives power from batteries (shown in FIG. 2 as reference number 250). Gears 314 and 316 are optional and are provided to reduce the rotational speed and/or increase torque output of motor electrical motor 320 if such speed reduction or torque increase is needed. Gears 314, 316, and motor 320 are coupled to a housing 322. Housing 322 is coupled to a spring 324, which permits a certain degree of lateral movement (left/right in the view of FIG. 2). Spring 324 is slightly compressed, thus exerting a force that biases housing 322 in the direction away from wall 330 toward helical auger 310. Together with motor 320, spring 324 provides actuation force to move paintballs along the paintball conduit toward the breech. A stud 332 is provided to retain spring 324 in place.

Helical auger 310 turns counter-clockwise when viewed along arrow 350 in order to feed paintballs along the paintball conduit toward the breech. Core 312 is shown with a concave portion 354 to accommodate paintballs queuing toward opening 352. When the paintball conduit is full, i.e., the breech is closed or not receiving paintballs, paintballs feeding cannot proceed since the paintballs are jammed against one another inside the paintball conduit at least between opening 352 and the breech entrance. The counter-clockwise rotation of helical auger 310 imparts a force against the stationary paintballs, such as paintball 306*e*, which pushes helical auger 310 to the left in the direction of arrow 350. Since helical auger 350 is coupled to gear 314 and housing 322, housing 322 is pushed to the left in the direction of arrow 350. When housing 322 is moved to the left, contact with a switch 360 is broken. Switch 360 controls motor 320. When contact with switch 360 is broken, current to motor 320 is interrupted, thus stopping the rotation of gears 316 and 314 as well as the rotation of helical auger 310. With helical auger 310 no longer rotating, helical auger 310 no longer feeds paintballs along the paintball conduit toward breech 208. In this state, battery power is conserved. In the pneumatic implementation, motor 320 and switch 360 may be implemented by pneumatic motor and switch, for example.

However, the leftward movement of housing 322 along the direction of arrow 350 further compresses spring 324. Spring 324 now exerts a force on housing 322 and the ridges of helical auger 310 to urge paintballs disposed in slots between the auger teeth/ridges in the direction toward opening 352 and breech 208. These paintballs in turn push on the balls already in the paintball conduit that are in the paintball transport arrangement 220 and breech 208. If the breech remains closed, the paintballs simply stayed queued up in the paintball conduit, with spring 324 exerting force (via helical auger 310) against the paintballs queued tip in the paintball conduit. Note that this force is applied by spring 324, requiring no battery power from battery 250. If the breech opens and is available to accept paintballs, the biasing force exerted by spring 324 causes the queued up paintballs to move in the direction toward the breech, thereby deposition at least one paintball into breech 208 (see FIG. 2).

Since there are fewer paintballs in the paintball conduit in the position distal of opening 352 after a paintball partially or completely moves into the breech, the paintballs urged by spring 324 move to the right within the conduit, thereby allowing housing 322 to make contact again with switch 360. With contact made, current is restored to motor 320, and helical auger 310 again rotates to feed more paintballs toward breech 208 along the paintball conduit. If the breech remains closed, the paintballs will again be jammed against one another within the paintball conduit, thereby again causing helical auger 310 to push housing 322 to the left in the direction of arrow 350. This movement of housing 322 again breaks contact with switch 360, thereby cutting off current flow to motor 320, and the cycle continues in the manner discussed earlier. In this manner, the linearly translatable motion of housing 322 achieves the on/off control of the actuator (e.g., of motor 320).

FIG. 3 also shows a flexible bias mechanism 360, which may be implemented by, for example, a curved piece of plastic or metal. Flexible bias mechanism 360 helps directs paintballs into slots between the ridges or teeth of helical auger 310, thereby ensuring trouble-free feeding of paintballs along the paintball conduit.

As can be appreciated from the foregoing, current is only required in the brief moment when there is room in the paintball conduit to move additional paintballs toward the breech (e.g., after at least one paintball has been partially or fully fed into the breech). Once the breech is closed and paintballs are jammed against one another in the paintball conduit, current is no longer supplied to the motor (due to the opening of switch 360), thereby conserving battery power. While paintballs are jammed against one another in the conduit waiting for the breech to open, the biasing force that urges the paintballs in the paintball conduit toward the breech is supplied by spring 324, requiring no current from the batteries during the wait state.

Further, the feeding of paintballs into the breech is accomplished automatically when the breech opens (since spring 324 pushes paintballs queued in the paintball conduit toward the breech without suffering any switch-related or motor-related or control-related delay, and helical auger 310 further feeds paintballs toward the breech after switch 360 is closed). After at least one paintball has been fed into the breech and the breech closes, thus accepting no further paintballs, paintball feeding stops after the paintballs are jammed in the paintball conduit (due to the rotation of helical auger 310, which causes housing 322 to move to the left in the direction of arrow 350, thus breaking contact with switch 360). In this manner, paintball feeding starts/stops are accomplished automatically without operator intervention.

Figure 4:
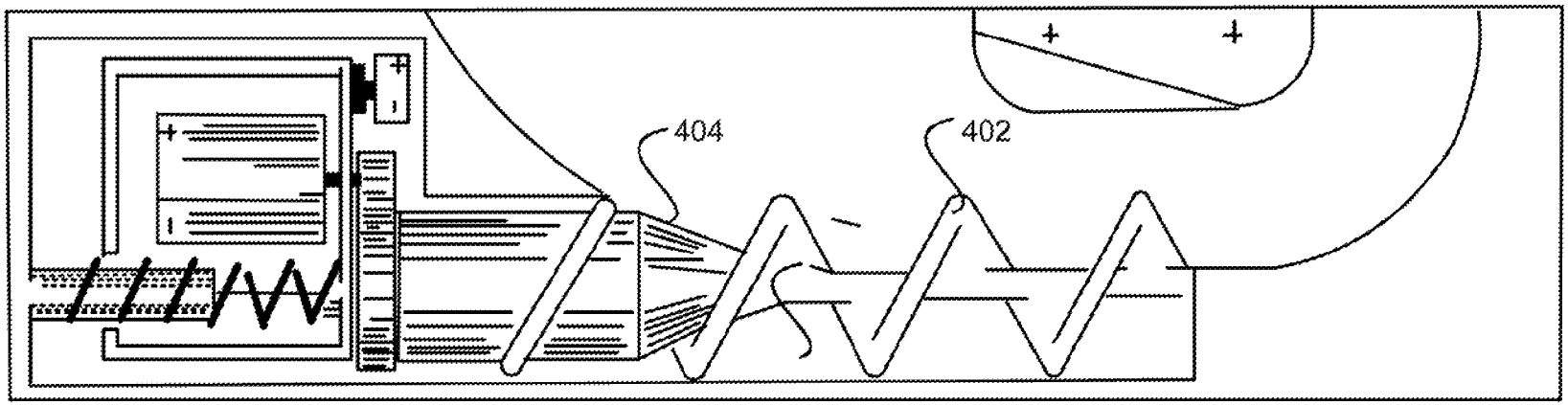
FIG. 4 shows, in accordance with an embodiment of the invention, a screw auger implementation.

Although FIG. 3 shows a helical auger, it is also possible to employ other mechanisms for feeding paintballs toward the breech along the paintball conduit. FIG. 4 shows, in accordance with an embodiment of the invention, a screw auger implementation in which screw auger 402 and core 404 rotate and translate left/right to accomplish the switch opening/closing as discussed in connection with FIG. 3 to automatically control the feeding of paintballs toward the breech.

Figure 5A:
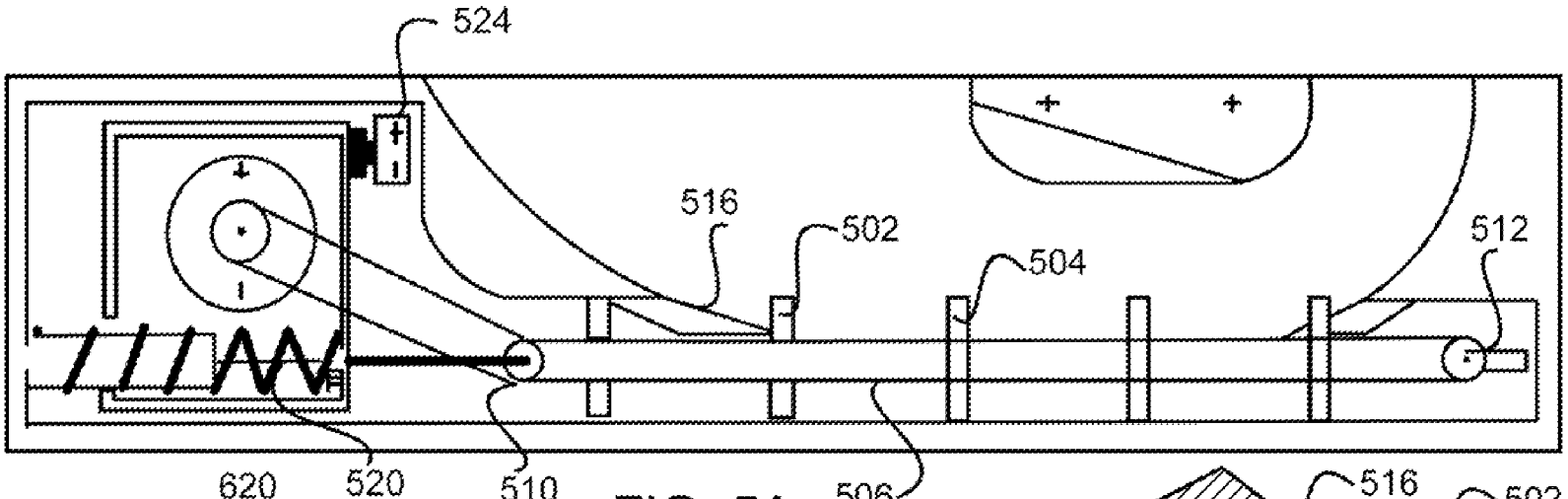
FIGS. 5A and 5B show, in accordance with an embodiment of the invention, a conveyor belt implementation.
Figure 5B:
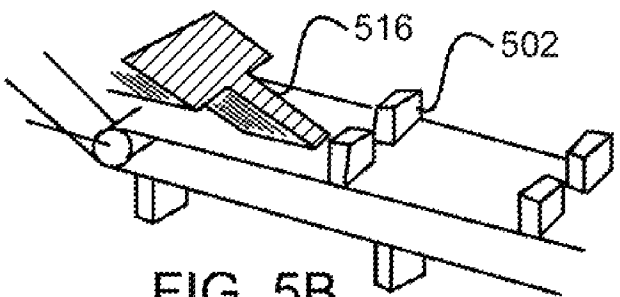

FIG. 5A shows, in accordance with an embodiment of the invention, a conveyor belt implementation in which paddles (such as paddles 502 and 504) are attached to a conveyor belt 506. Conveyor belt 506 rides on pulleys 512 and 510, one of which may be rotated by an appropriate electrical motor and/or gear combination. When conveyor belt 506 moves in the clockwise direction (as viewed into the page of FIG. 5A), the paddles move paintballs trapped between paddles toward the breech. Using spring 520 and switch 524, electrical contact make/break may be made to automatically start/stop paintball feeding in the manner analogous to that discussed earlier in connection with FIG. 3. FIG. 5B shows ramp 516 and paddle 502 in greater detail, in accordance with an embodiment of the present invention. In another embodiment, a paddle may be disposed in the middle of the conveyor belt and the ramp can be split to straddle the paddle as the paddle rotates on the conveyor belt.

Figures 6A, 6B:
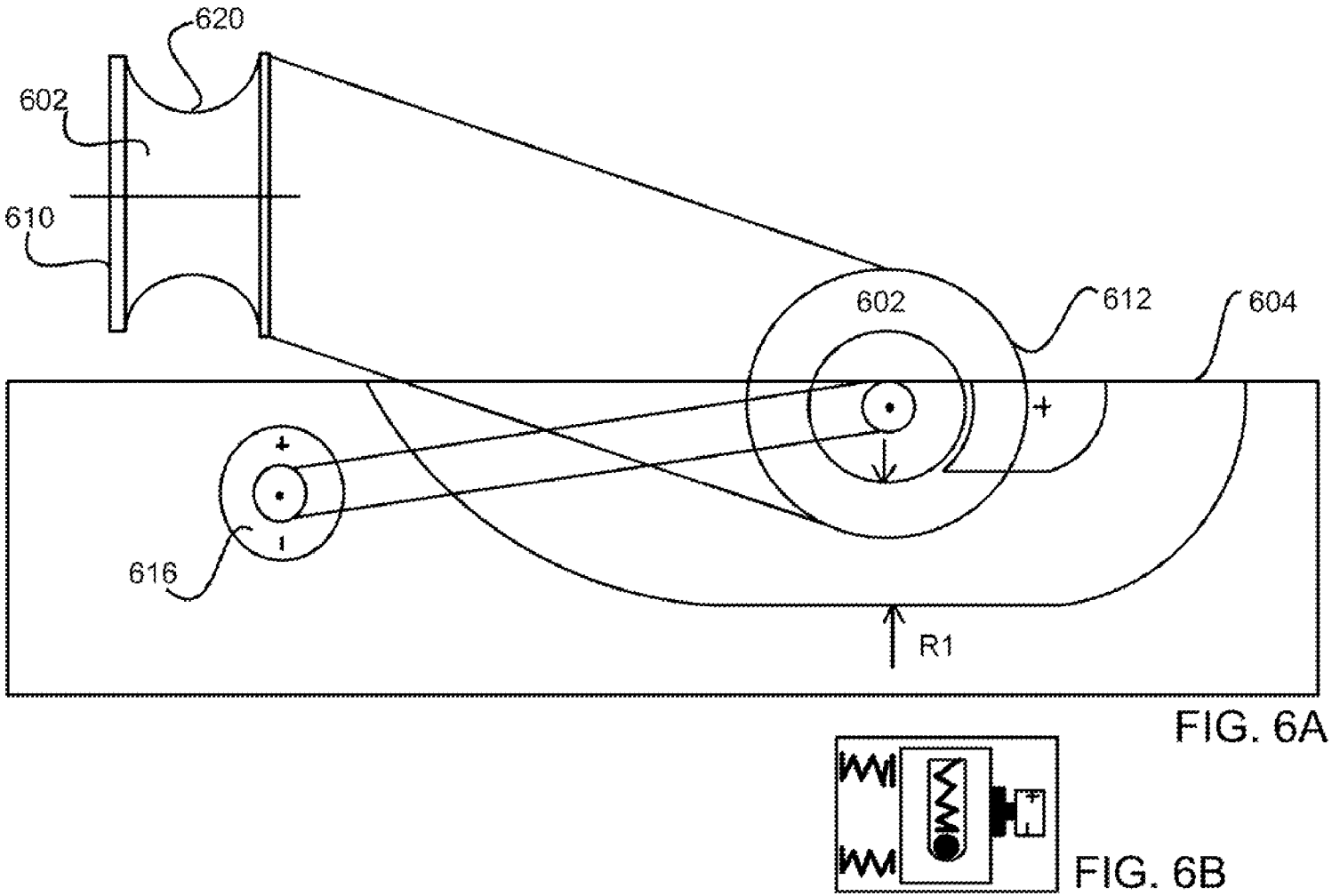
FIGS. 6A and 6B show, in accordance with an embodiment of the invention, a friction wheel implementation.

FIG. 6A shows, in accordance with an embodiment of the invention, a friction wheel implementation whereby a friction wheel 602 is employed to feed paintballs toward opening 604 and toward the breech. To facilitate discussion, friction wheel 602 is shown in its operational position (as indicated by reference arrow 612) and in a version that has been rotated 90 degrees to facilitate discussion (as indicated by reference arrow 610). In the example of FIG. 6A, friction wheel 602 has a groove (shown in the rotated version pointed to by arrow 620) to accommodate paintballs although the groove is not absolutely necessary. The paintball-contacting surface of friction wheel 602 is preferably a surface that has a sufficient coefficient of friction with the paintballs to help move the paintballs toward opening 604 and toward the breech when friction wheel 602 rotates in a counter-clockwise direction by motor 616 (when viewed into the page of FIG. 6A).

In the example of FIG. 6A, friction wheel 602 is permitted some degree of vertical movement while tending to be biased downward (using for example a spring) to allow for variation in the size of the paintball and some degree of horizontal movement to detect when paintballs are jammed against one another in the paintball conduit. The inner diameter of friction wheel 602 (indicated by reference arrow 620) is separated from the bottom of the paintball conduit by a distance R1 as shown wherein the height of the paintball conduit portion that is distal (relative to the operator when the gun is pointed away from the operator) to friction wheel 602 is slightly larger than R1. The constriction caused by the smaller R1, which is sized to be slightly smaller than the paintball diameter, helps friction wheel 602 pushes paintballs to the right toward opening 604 and the breech. Again, using an appropriate electrical contact making/breaking arrangement such as that shown in FIG. 6B (which operates analogously to that discussed in connection with FIG. 3), paintball feeding starts/stops can be made automatic. The adaptation and variations of the electrical contact making/breaking arrangement of FIG. 3 and FIG. 6B to operate with the friction wheel of FIG. 6A is within the ability of one of ordinary skill in the art.

Embodiments of the invention also contemplate variations, including variations in the actuator and sensors. For example, the spring component of the actuator mechanism may be mounted anywhere and may be implemented alternatively or additionally by levers, leaf springs, elastic bands, elastic springs, torsion rods, etc. The switch employed to achieve on/off control may be mounted at any suitable location and implemented alternatively or additionally by lever switch, infrared sensor that detect auger movement or paintball movement, vibration sensor or sound sensor that senses when the gun is fired, etc.

Having disclosed exemplary embodiments and the best mode, modifications and variations may be made to the disclosed embodiments while remaining within the subject and spirit of the invention as defined by the following claims.

What is claimed is:

1. A paintball ejecting apparatus haying a body, a breech, and a barrel for ejecting paintballs through and out of said barrel, comprising:

a paintball reservoir disposed in an other-than-top-of-body position;

a paintball conduit coupling said paintball reservoir to said breech for facilitating transport of paintballs from said paintball reservoir to said breech;

a movable paintball transport arrangement haying an actuator that provides paintball-moving force on at least some of said paintballs in said paintball reservoir, said movable paintball transport arrangement occupying a first position and automatically moves at least a first paintball from said paintball conduit into said breech if said breech is empty and open for receiving said at least first paintball, said movable paintball transport arrangement automatically ceasing moving another paintball into said breech after said at least first paintball is disposed in said breech, wherein said movable paintball transport arrangement occupies a second position when said movable paintball transport arrangement ceases moving paintballs into said breech; and a switch operatively activated by physical contact with said movable paintball transport arrangement, said movable paintball transport arrangement mechanically actuating said switch to provide electrical current to said actuator when said movable paintball transport arrangement occupies said first position, said movable paintball transport arrangement mechanically actuating said switch to cease providing the electrical current to said actuator when said movable paintball transport arrangement occupies said second position.

2. The paintball ejecting apparatus of claim 1 wherein said paintball transport arrangement is configured to move another paintball from said paintball conduit into said breech after said at least first paintball is ejected out of said breech.

3. The paintball ejecting apparatus of claim 1 wherein said paintball transport arrangement includes an auger operatively coupled to said actuator for moving said paintballs from said paintball reservoir into said conduit.

4. The paintball ejecting, apparatus of claim 3 wherein said auger represents a screw auger.

5. The paintball ejecting apparatus of claim 1 wherein said paintball transport arrangement includes a conveyor belt operatively coupled to said actuator for moving said paintballs from said paintball conduit toward said breech.

6. The paintball ejecting apparatus of claim 1 wherein said paintball transport arrangement includes to friction wheel operatively coupled to said actuator for moving said paintballs from said paintball conduit toward said breech.

7. The paintball ejecting apparatus of claim 1 wherein said paintball transport arrangement includes a flexible guide for urging paintballs into slots of said paintball transport arrangement.

8. The paintball ejecting apparatus of claim 1 wherein said actuator is coupled to a housing, said housing is configured to be linearly translatable.

9. The paintball ejecting apparatus of claim 1 wherein at least a portion of said paintball-moving force causes said movable transport arrangement to move from said first position to said second position when said breech is occupied by a paintball.

10. The paintball ejecting apparatus of claim 9 wherein said anger represents a helical auger that rotates around a non-rotating core.

11. The paintball ejecting apparatus of claim 1 further comprising a spring coupled to said movable paintball transport arrangement, the spring supplying a force to urge paintballs in said conduit toward said breech in a wait state when a paintball occupies said breech and said movable paintball transport arrangement is in said second position such that no electrical current is supplied to said actuator.

12. A paintball gun having a handle, a trigger, a breech, and a barrel for ejecting paintballs through and out of said barrel, comprising:

a paintball reservoir disposed proximal of said handle, wherein said handle is disposed in between said paintball reservoir and said trigger;

a paintball conduit coupling said paintball reservoir to said breech for facilitating transport of paintballs from said paintball reservoir to said breech;

a movable paintball transport arrangement having an actuator that provides paintball-moving force on at least some of said paintballs in said paintball reservoir, said movable paintball transport arrangement occupying a first position and automatically moves at least a first paintball from said paintball conduit into said breech if said breech is empty and open for receiving said at least first paintball, said movable paintball transport arrangement automatically ceasing moving another paintball into said breech after said at least first paintball is disposed in said breech, wherein said movable paintball transport arrangement occupies a second position when said movable paintball transport arrangement ceases moving paintballs into said breech; and a switch operatively activated by physical contact with said movable paintball transport arrangement, said movable paintball transport arrangement mechanically actuating said switch to provide electrical current to said actuator when said movable paintball transport arrangement occupies said first position, said movable paintball transport arrangement mechanically actuating said switch to cease providing the electrical current to said actuator when said movable paintball transport arrangement occupies said second position.

13. The paintball gun of claim 12 wherein said actuator includes an electrical motor.

14. The paintball gun of claim 12 wherein said paintball transport arrangement is configured to move another paintball from said paintball conduit into said breech after said at least first paintball is ejected out of said breech.

15. The paintball gun of claim 14 wherein said auger represents a screw auger.

16. The paintball gun of claim 12 wherein said paintball transport arrangement includes an auger operatively coupled to said actuator for moving said paintballs from said paintball conduit toward said breech.

17. The paintball gun of claim 16 wherein said auger represents a helical auger that rotates around a non-rotating core.

18. The paintball gun of claim 12 wherein said paintball transport arrangement includes a conveyor belt operatively coupled to said actuator for moving said paintballs from said paintball conduit toward said breech.

19. The paintball gun of claim 12 wherein said paintball transport arrangement includes a friction wheel operatively coupled to said actuator for moving said paintballs from said paintball conduit toward said breech.

20. The paintball gun of claim 12 wherein said paintball transport arrangement includes a flexible guide for urging paintballs into slots of said paintball transport arrangement.

21. The paintball gun of claim 12 wherein said actuator is coupled to a housing, said housing is configured to be linearly translatable.

22. The paintball gun of claim 12 wherein at least a portion of said paintball-moving three causes said movable transport arrangement to move from said first position to said second position when said breech is occupied by a paintball.

23. The paintball gun of claim 22 wherein said paintball transport arrangement includes an auger operatively coupled to said actuator for moving said paintballs from said paintball conduit toward said breech.

24. The paintball gun of claim 12 further comprising a spring coupled to said movable paintball transport arrangement, the spring supplying a force to urge paintballs in said conduit toward said breech in a wait state when a paintball occupies said breech and said movable paintball transport arrangement is in said second position such that no electrical current is supplied to said actuator.

* * * * *